US011168889B2

(12) United States Patent
Ibrahim

(10) Patent No.: US 11,168,889 B2
(45) Date of Patent: Nov. 9, 2021

(54) SAFELY KNOB ASSEMBLY FOR A BURNER

(71) Applicant: Fadi Ismail Ibrahim, Bloomfield Hills, MI (US)

(72) Inventor: Fadi Ismail Ibrahim, Bloomfield Hills, MI (US)

( * ) Notice: Subject to any disclaimer, the term of this patent is extended or adjusted under 35 U.S.C. 154(b) by 122 days.

(21) Appl. No.: 16/826,264

(22) Filed: Mar. 22, 2020

(65) Prior Publication Data

US 2020/0300475 A1 Sep. 24, 2020

Related U.S. Application Data

(60) Provisional application No. 62/822,809, filed on Mar. 23, 2019.

(51) Int. Cl.

| | |
|---|---|
| ***G05G 1/08*** | (2006.01) |
| ***F24C 3/12*** | (2006.01) |
| ***G05G 5/00*** | (2006.01) |
| ***G05G 1/10*** | (2006.01) |
| *F24C 5/16* | (2006.01) |

(52) U.S. Cl.

CPC ..... *F24C 3/124* (2013.01); *G05G 1/082* (2013.01); *G05G 1/10* (2013.01); *G05G 5/005* (2013.01); *F24C 5/16* (2013.01)

(58) Field of Classification Search

CPC ..... G05G 1/08; G05G 1/082; G05G 1/10; G05G 1/12; F24C 3/12; F24C 3/122; F24C 3/124; F24C 3/126; F24C 3/128; F24C 5/16; F24C 7/08; F24C 7/081; F24C 7/082; H01H 3/20

See application file for complete search history.

(56) References Cited

U.S. PATENT DOCUMENTS 1,446,652 A * 2/1923 Morris ..... G05G 1/08 74/553

3,662,618 A 5/1972 Kroll et al.

(Continued)

*Primary Examiner* — Richard W Ridley
*Assistant Examiner* — Brian J McGovern
(74) *Attorney, Agent, or Firm* — Mastrogiacomo PLLC; Patrick Mastrogiacomo, Jr.

(57) ABSTRACT

A safety knob assembly for actuating a burner is provided. The safety knob assembly includes a dial, the dial includes at least one alignment hole, an interlock disk, the interlock disk includes at least one locking pin, the at least one locking pin having an outer diameter less than then the inner diameter of the at least one alignment hole, a safety post, the safety post connected to the dial and the safety post including a locking hub, the locking hub connected to a switch post, a spring, the spring sized such that the inner diameter of the spring is larger than the outside diameter of the safety post, the spring positioned on the safety post and positioned between the dial and the locking post, wherein the at least one locking pin of the interlock disk engages the at least one alignment hole of the dial as a bottom surface of the dial approaches a top surface of the interlock disk, wherein the interlock disk engages the locking hub as a bottom surface of the interlock disk approaches the locking hub, and wherein the burner is actuated as the dial, the interlock disk, the safety post and the locking hub are positioned to rotate the switch post relative to the burner to allow the flow of energy from an energy source to the burner.

7 Claims, 17 Drawing Sheets

(56) References Cited

U.S. PATENT DOCUMENTS

| | | | | | |
|---|---|---|---|---|---|
| 3,986,409 | A | * | 10/1976 | Tripp | G05G 1/02 74/548 |
| 4,300,525 | A | | 11/1981 | Delgado et al. | |
| 4,549,716 | A | * | 10/1985 | Warren | F16K 31/60 192/69.91 |
| 4,955,253 | A | | 9/1990 | Sakai et al. | |
| 5,048,365 | A | * | 9/1991 | Webb | G05G 1/082 74/553 |
| 5,363,720 | A | | 11/1994 | Sanchez | |
| 5,384,442 | A | | 1/1995 | Danner | |
| 5,513,831 | A | * | 5/1996 | Seward | F16K 35/027 192/95 |
| 5,931,150 | A | | 8/1999 | Bowen et al. | |
| 6,394,081 | B1 | | 5/2002 | Aguirre-Esponda et al. | |
| 8,292,494 | B2 | | 10/2012 | Rosa et al. | |
| 8,516,736 | B2 | | 8/2013 | Windauer | |
| 8,967,019 | B2 | | 3/2015 | O'Keefe et al. | |
| 9,194,589 | B2 | | 11/2015 | Dondurur et al. | |
| 9,347,665 | B2 | | 5/2016 | Gadini et al. | |
| 9,852,856 | B2 | | 12/2017 | Bowen | |
| 9,971,322 | B2 | | 5/2018 | Bach et al. | |
| 2005/0202361 | A1 | * | 9/2005 | Albizuri | F23N 1/007 431/354 |
| 2006/0254573 | A1 | | 11/2006 | Steinman et al. | |
| 2015/0053043 | A1 | * | 2/2015 | Livolsi | G05G 5/005 74/553 |
| 2017/0235328 | A1 | | 8/2017 | Swayne et al. | |
| 2017/0328574 | A1 | | 11/2017 | Williams | |
| 2020/0149745 | A1 | * | 5/2020 | Kim | G05G 5/005 |

* cited by examiner

SAFELY KNOB ASSEMBLY FOR A BURNER

CROSS REFERENCE TO RELATED APPLICATIONS

This patent application claims the benefit of priority based on U.S. Provisional Patent Application No. 62/822,809 filed on Mar. 23, 2019, which is incorporated by reference in its entirety for all purposes.

STATEMENT REGARDING FEDERALLY SPONSORED RESEARCH OR DEVELOPMENT

Not Applicable

Incorporation-by-Reference of Material Submitted on Compact Disc

Not Applicable

BACKGROUND OF THE INVENTION

1. Field of the Invention

The present invention relates generally to a knob assembly for regulating the amount of energy delivered to a burner of a typical stove, oven or grill used to cook and heat food and liquids and, more particularly, to safety improvements in the knob assembly to ensure the burner may not accidently be actuated.

2. Background Art

A knob has been used on stoves, ovens and grills to actuate a burner to cook or warm food and liquid for the last several decades. An individual need only to simply turn the knob to a specified position to start the flow of energy through the stove to the burner or oven. Typically, that energy may be some type of gas such as natural gas or propane or electricity. The stove, oven or grill transforms that energy into heat for heating or cooking food and liquid.

The stove, oven or grill may include a number of burner areas to allow multiple items to be cooked at one time. Generally, a single knob controls the flow of energy to a single burner. The knobs are used to begin the initial flow of energy to the burner, to adjust the amount of energy at the burner and turn off the flow of energy to the burner when the cooking task has been completed. In a stove, oven or grill that operates with natural gas or propane, the knob may also be used to actuate an igniter that creates an ignition source to ignite the gas.

As stated above, actuating a knob to begin the flow of energy to the burner is very easy to accomplish. An individual may simply turn the knob to the desired dial location to begin the flow of energy to the burner. An issue arises with unsupervised young children have access to the knob and can simply turn the knob and unknowingly start the flow of energy to the burner. Further, there are also issues with the elderly and those that are ill and forgetful. They may actuate the knob accidently or do so intentionally to cook or heat food or liquid and forget to turn the knob back to the off position to end the flow of energy to the burner. Burners controlled by knobs that have been left in the on position and unattended pose a risk of burn and/or fire to individuals and property. Still further, if the knob is used to actuate a burner that uses gas for energy, a pilot or electronic ignition source may not be activated and the gas flowing to the burner will not be ignited. Gas will continue to flow out of the burner as long as the knob is in any on position. Gas burners controlled by knobs left in the on position as pose the risk of gas build-up within the dwelling which may lead to asphyxiation of an individual or possible explosion if the gas encounters an ignition source.

Therefore, a need exists for a safety knob assembly that can be actuated by an individual for the specific task of cooking or heating foods and liquids while at the same time, greatly hindering the ability of an unsupervised child, elderly adult or ill person to unintentionally actuate the safety knob assembly.

BRIEF SUMMARY OF THE INVENTION

A safety knob assembly for actuating a burner is provided. The safety knob assembly includes a dial, the dial includes at least one alignment hole, an interlock disk, the interlock disk includes at least one locking pin, the at least one locking pin having an outer diameter less than then the inner diameter of the at least one alignment hole, a safety post, the safety post connected to the dial and the safety post including a locking hub, the locking hub connected to a switch post, a spring, the spring sized such that the inner diameter of the spring is larger than the outside diameter of the safety post, the spring positioned on the safety post and positioned between the dial and the locking post, wherein the at least one locking pin of the interlock disk engages the at least one alignment hole of the dial as a bottom surface of the dial approaches a top surface of the interlock disk, wherein the interlock disk engages the locking hub as a bottom surface of the interlock disk approaches the locking hub, and wherein the burner is actuated as the dial, the interlock disk, the safety post and the locking hub are positioned to rotate the switch post relative to the burner to allow the flow of energy from an energy source to the burner.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
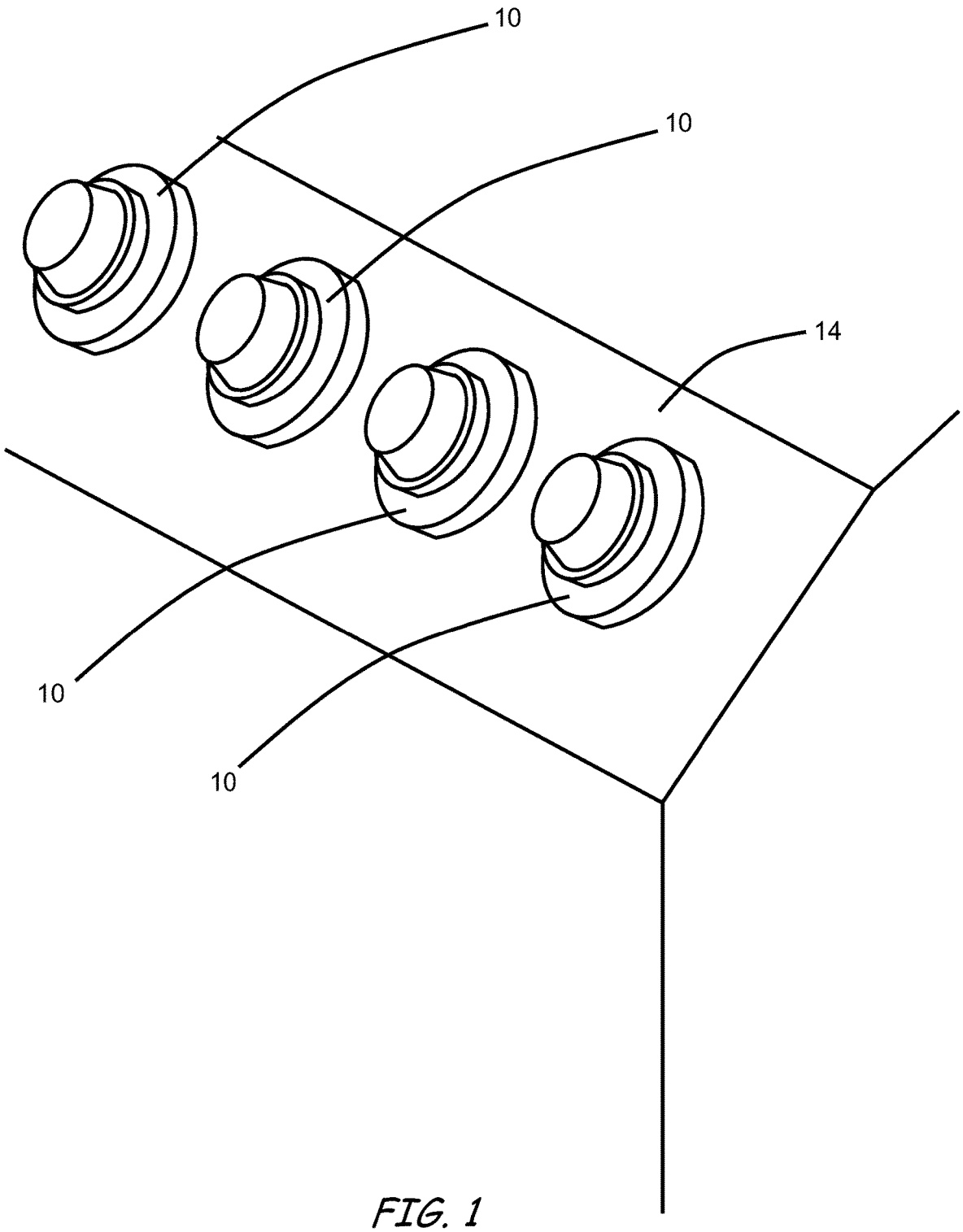
FIG. 1 is a perspective view of a safety knob assembly for adjusting the heating element of a burner according to an embodiment of the present invention.
Figure 2:
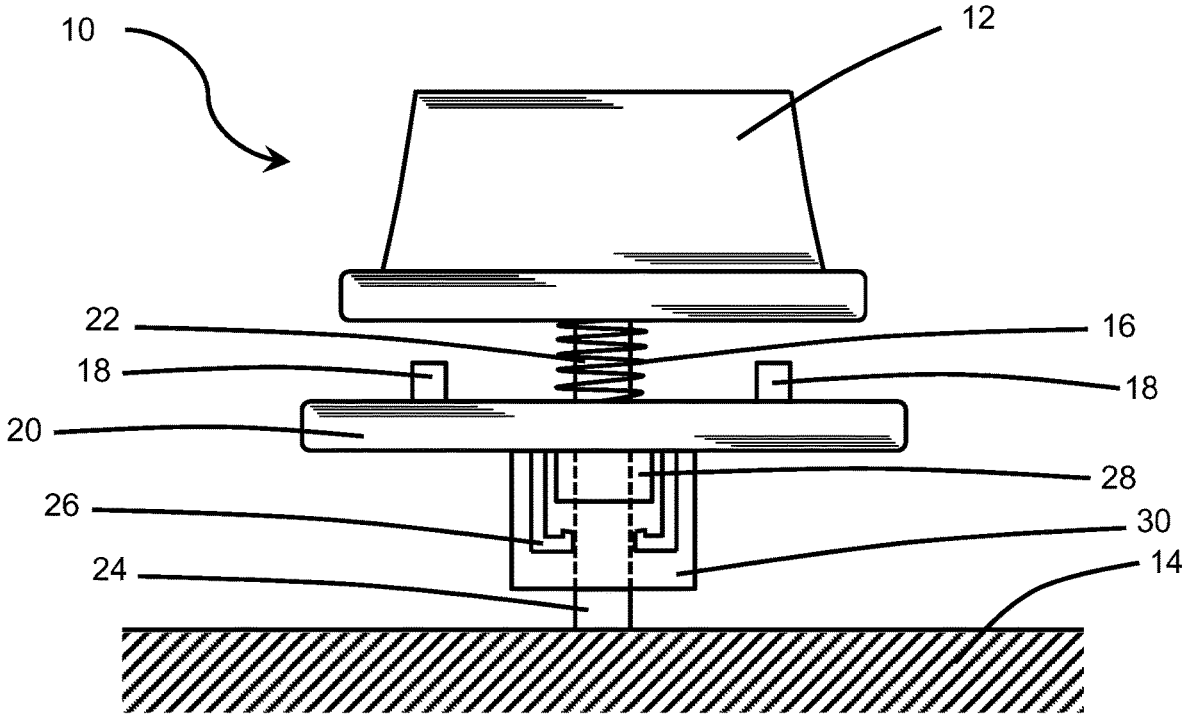
FIG. 2 is a side view of the safety knob assembly shown in a first position according to an embodiment of the present invention.
Figure 3:
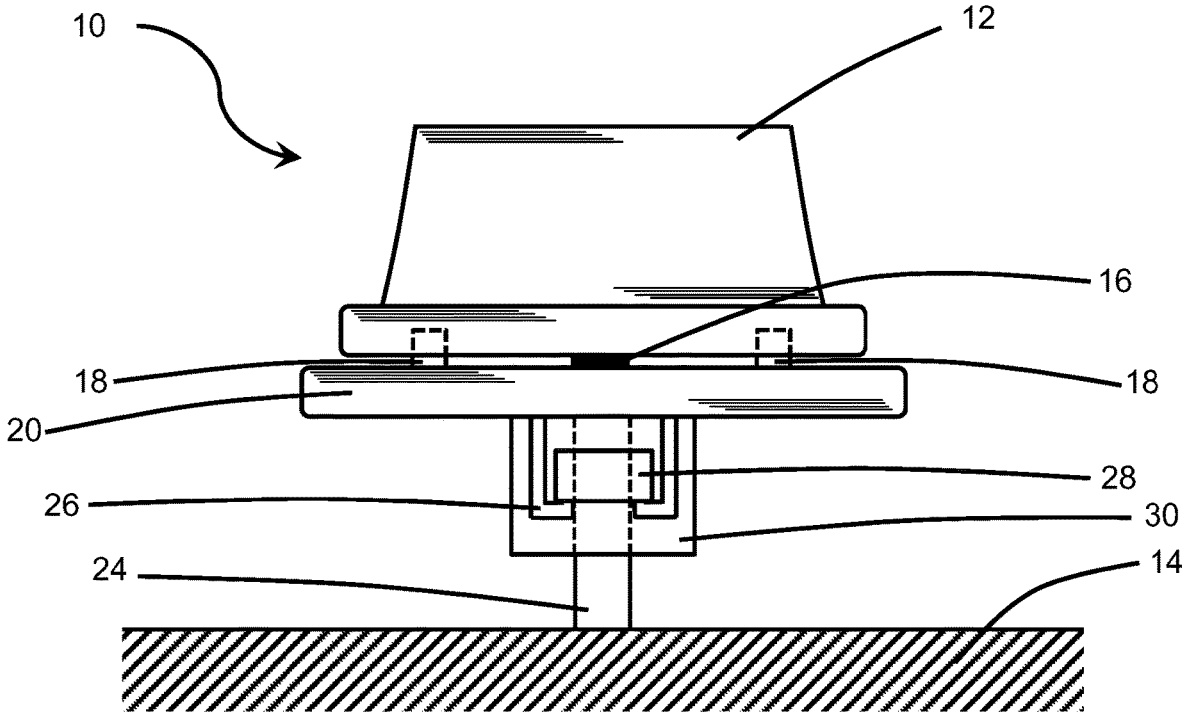
FIG. 3 is a side view of the safety knob assembly shown in a second position according to an embodiment of the present invention.
Figure 4:
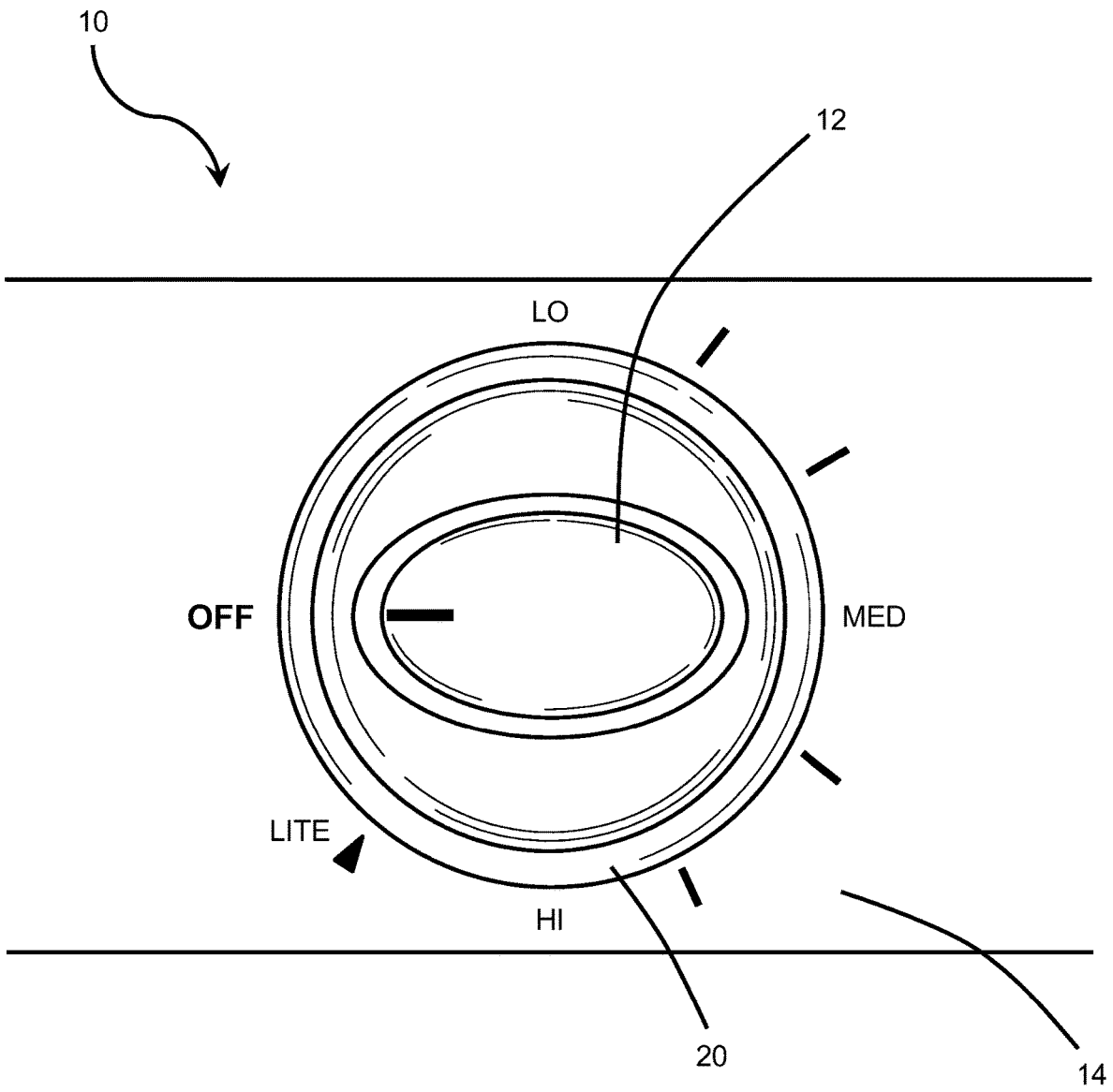
FIG. 4 is a plan view of the safety knob assembly according to an embodiment of the present invention.
Figure 5:
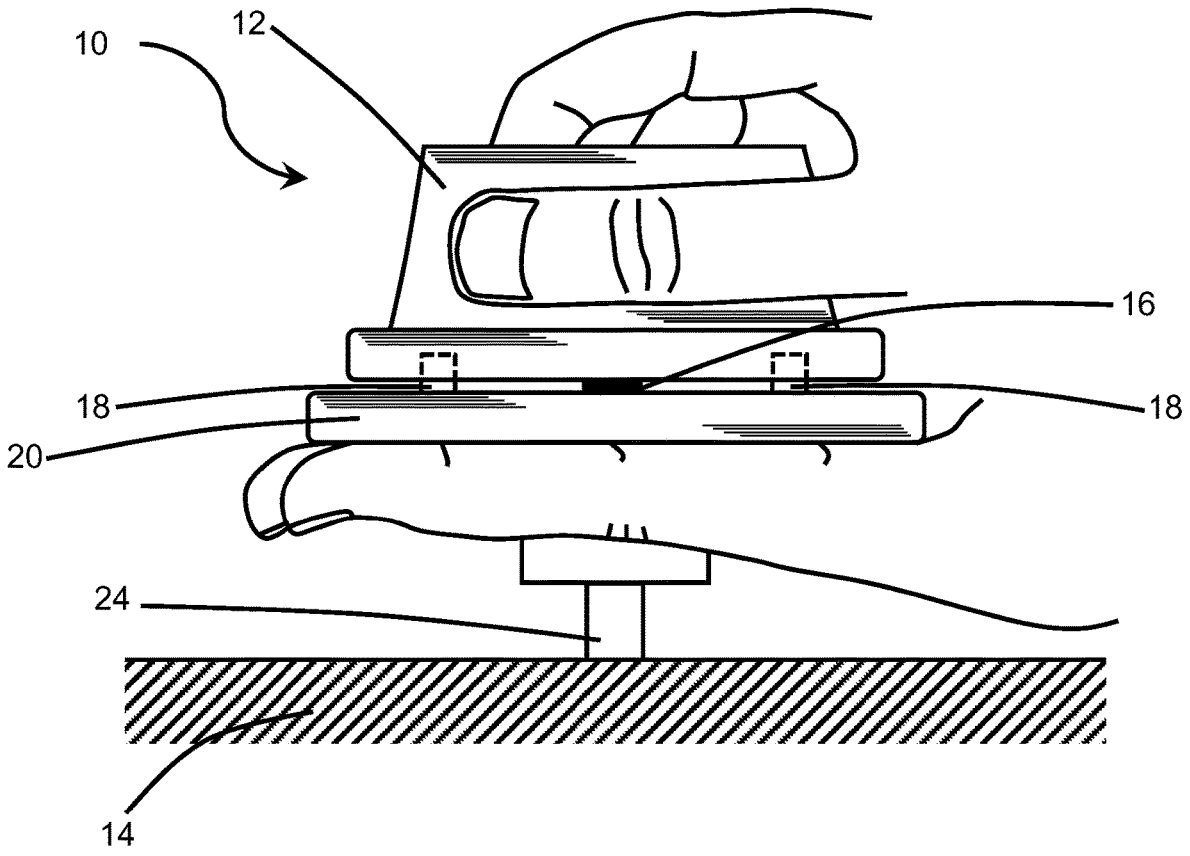
FIG. 5 is a side view of the safety knob assembly according to an embodiment of the present invention illustrating one means of actuating the safety knob assembly.
Figure 6:
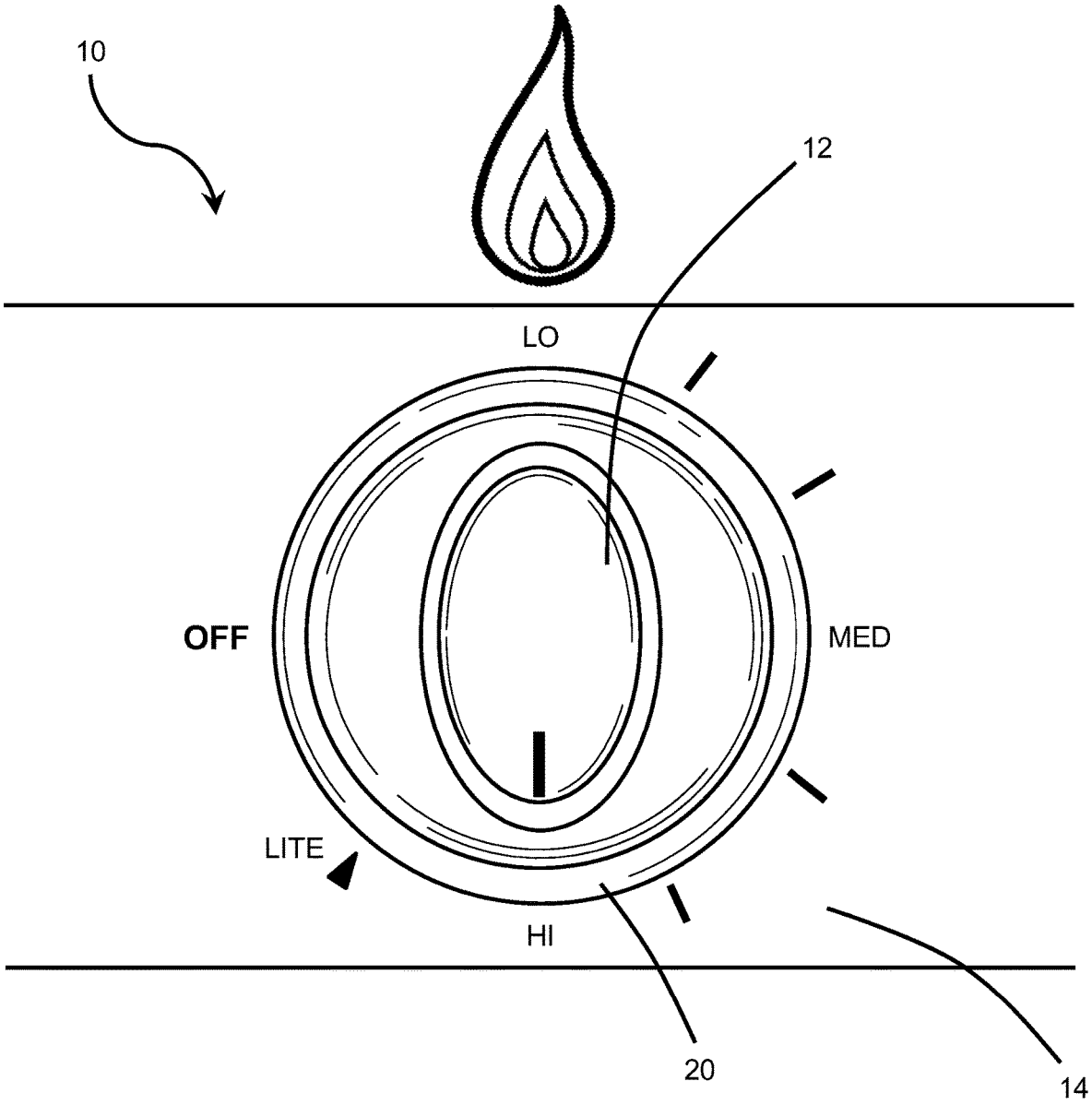
FIG. 6 is a plan view of the safety knob assembly according to an embodiment of the present invention.
Figure 7:
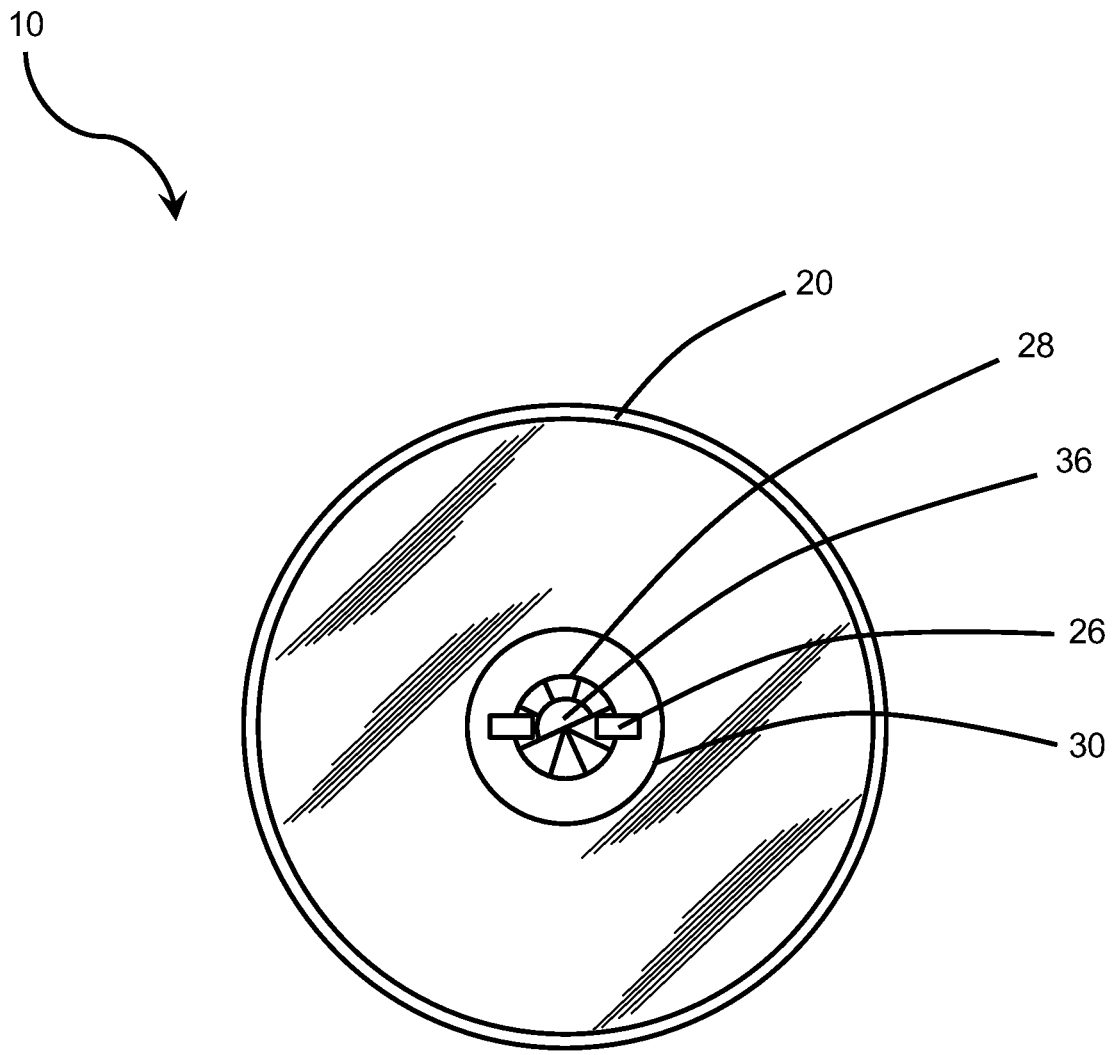
FIG. 7 is a bottom view of the safety knob assembly according to an embodiment of the present invention.
Figure 8:
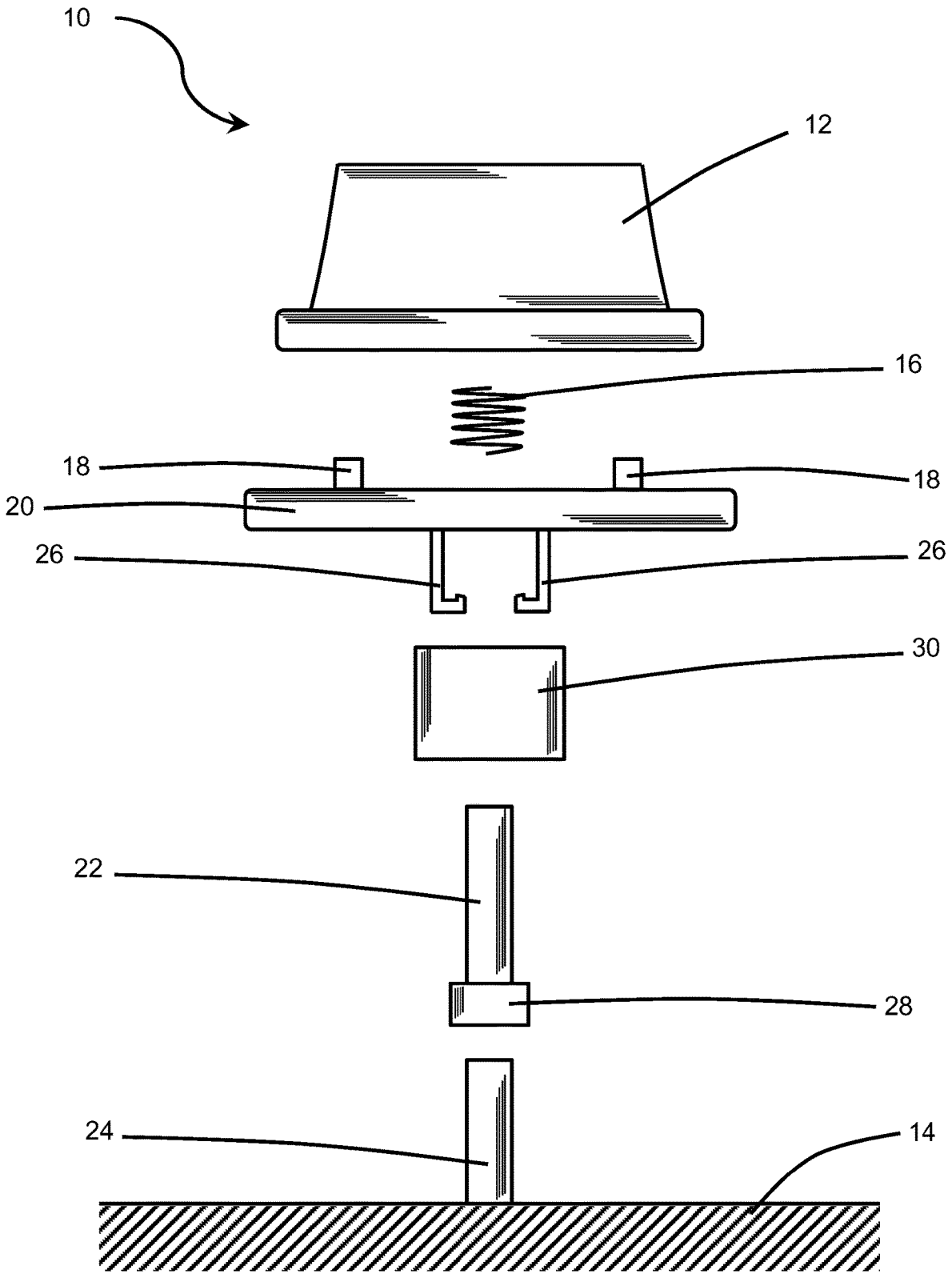
FIG. 8 is an exploded view of the safety knob assembly according to an embodiment of the present invention.
Figure 9:
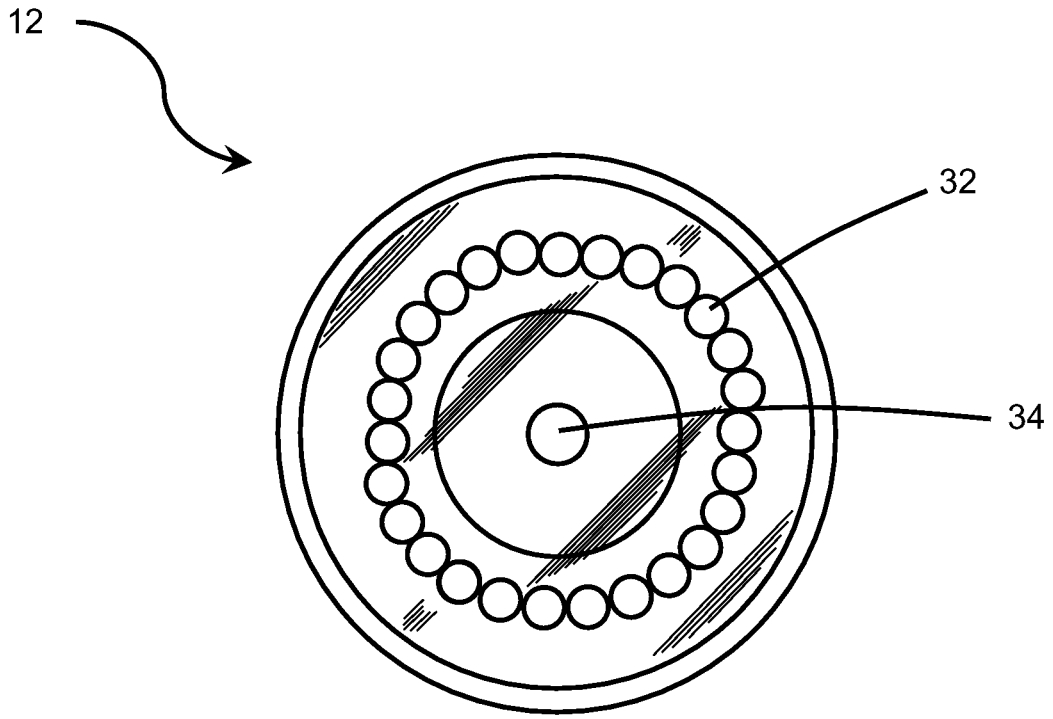
FIG. 9 is a bottom view of a dial of the safety knob assembly according to an embodiment of the present invention.
Figure 10:
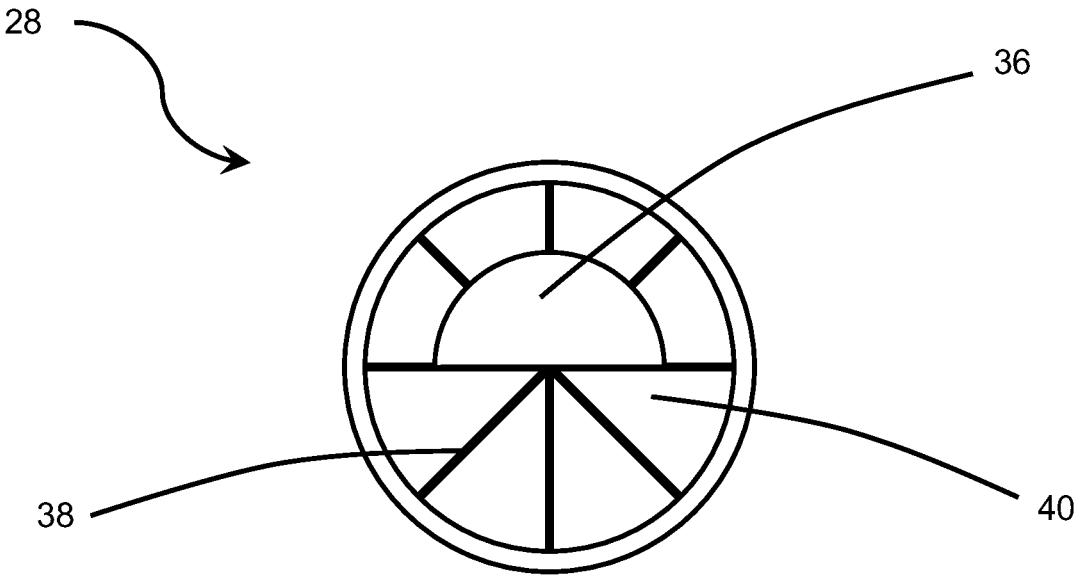
FIG. 10 is a bottom view of a locking hub of the safety knob assembly according to an embodiment of the present invention.
Figure 11:
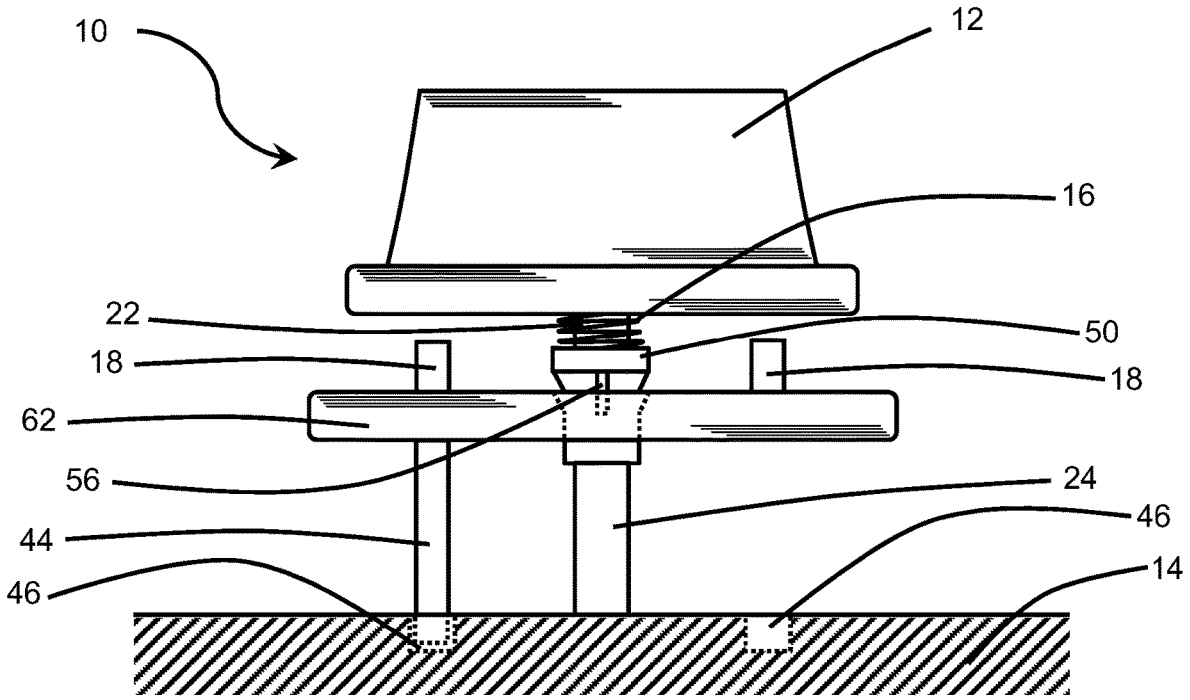
FIG. 11 is a side view of a safety knob assembly shown in a first position according to another embodiment of the present invention.
Figure 12:
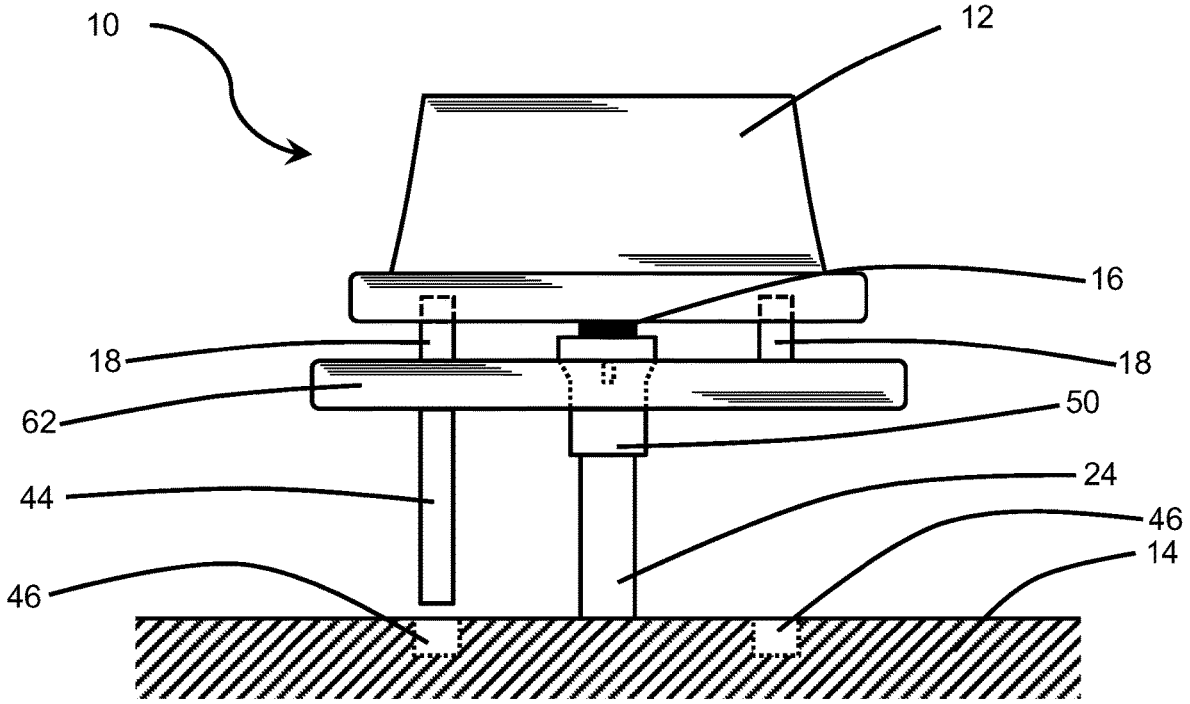
FIG. 12 is a side view of a safety knob assembly shown in a second position according to an embodiment of the present invention.
Figure 13A:
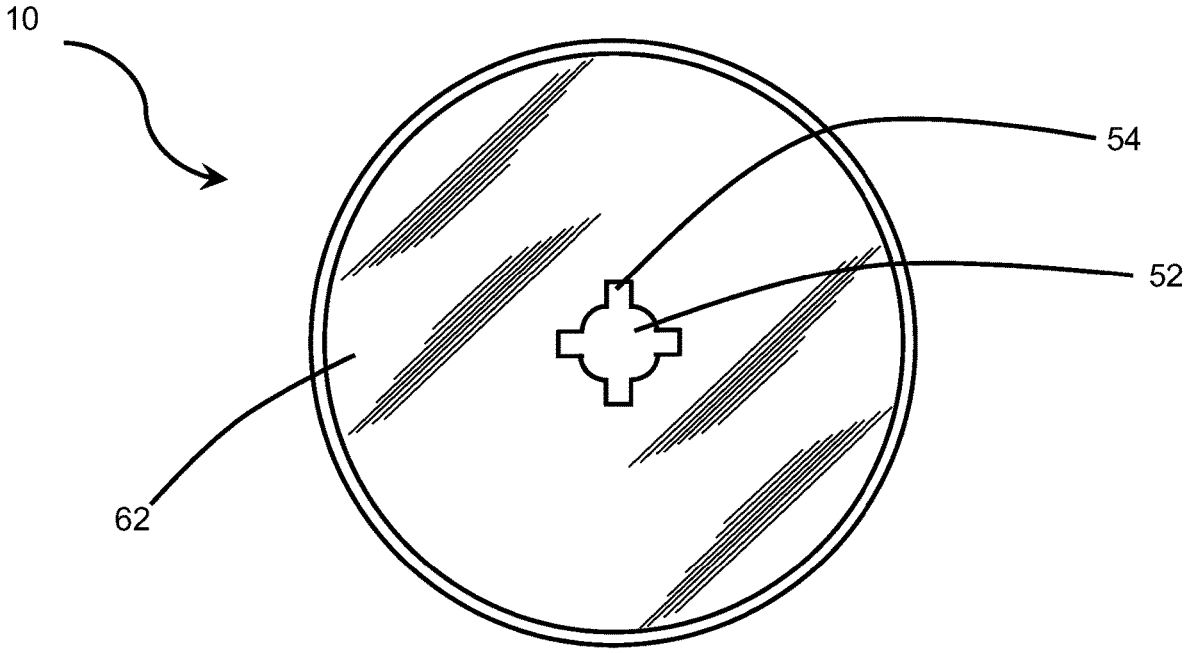
FIG. 13A is a bottom view of an interlocking disk of the safety knob assembly according to an embodiment of the present invention.
Figure 13B:
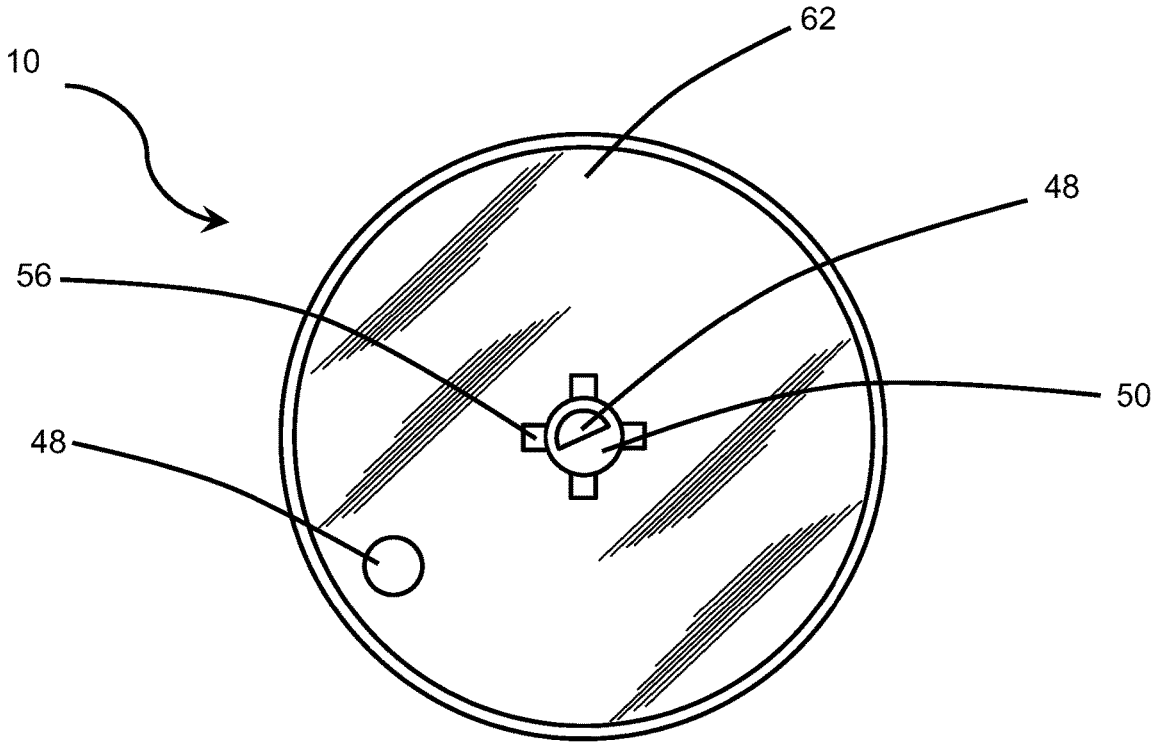
FIG. 13B is a bottom view of an interlocking disk and a locking hub of the safety knob assembly according to an embodiment of the present invention.
Figure 14:
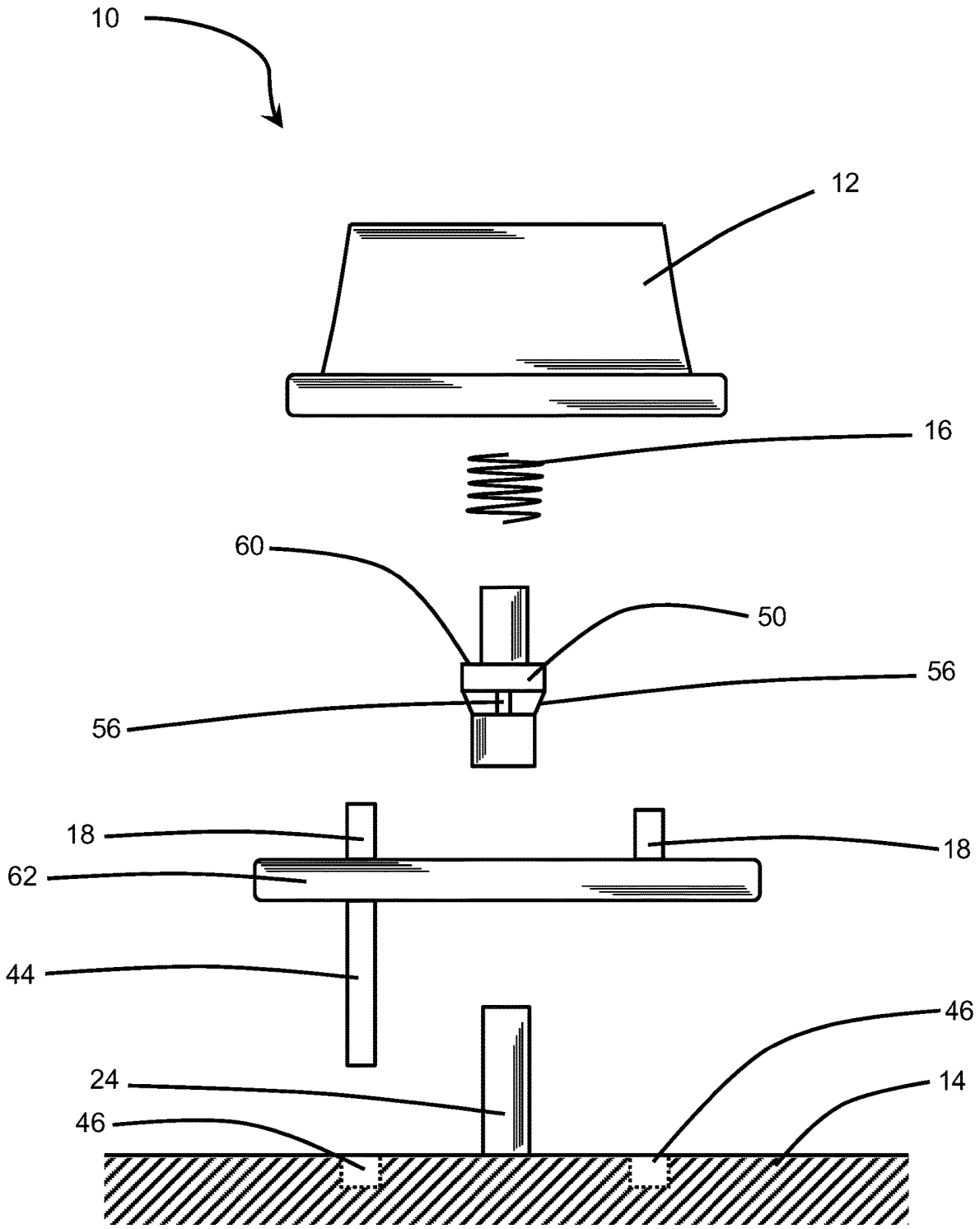
FIG. 14 is an exploded view of the safety knob assembly according to an embodiment of the present invention.

Referring now to the drawings, preferred illustrative embodiments of the present invention are shown in detail. Although the drawings represent embodiments of the present invention, the drawings are not necessarily to scale and certain features may be exaggerated to better illustrate and explain the present invention. Further, the embodiments set forth herein are not intended to be exhaustive or otherwise to limit or restrict the invention to the precise forms and configurations shown in the drawings and disclosed in the following detailed description.

A safety knob assembly 10 for a stove 14, an oven or a grill is illustrated in FIG. 1. Safety knob 10 may be used to actuate a burner by allowing energy to flow to the burner to create heat that will cook or heat food and liquids to a suitable temperature for eating. Typically, the energy may be in the form of a gas such as natural gas, propane and the like or electricity. Safety knob 10 includes means that will be fully described below to prevent accidental actuation of knob 10 to ensure the burner or the oven are not unintentionally energized.

Now referring to FIGS. 2-10, safety knob assembly 10 is attached at stove 14 at a switch post 24, switch post 24 having the profile of a half-moon, that extends outward from stove 14. Knob 10 includes a locking hub 28, locking hub 28 including a half-moon shaped hole 36 (see FIG. 10) sized to accept switch post 24 and secure knob 10 to stove 12. Locking hub 28 is secured to a safety post 22, safety post 22 extending outward from locking hub 28.

Knob assembly 10 also includes an interlock disk 20. Interlock disk 20 includes a hole 42 that is sized to allow safety post 22 to pass through hole 42 and allow interlock disk 20 to rotate freely about safety post 22. Interlock disk 20 may rest upon a top side of locking hub 28. Interlock disk 20 also includes at least one locking pin 18 that extends generally upward from a top surface of disk 20. Further, interlock disk 20 includes at least one prong 26 that extends generally downward from a bottom surface of disk 20. Prong 26 includes a hook for engaging locking hub 28. Locking hub 28 includes separators 38 that define voids 40. Voids 40 are sized to capture the hook of prong 26. A shield 30 extends downward from disk 20 to encase locking hub 28 and prong 26.

Knob assembly 10 further includes a dial 12 that is secured to knob assembly 10 at safety post 22. Dial 12 includes a hole 34 to is sized to accept safety post 22 and secure dial 12 to post 22. Dial 12 also includes at least one alignment hole 32 that is sized to accept locking pin 18 of interlock disk 20. Knob Assembly 10 also includes a spring 16 that is sized internally to allow safety post 22 to pass through freely. Spring is secured on post 22 between interlock disk 20 and dial 12. Spring 16 acts to maintain a clearance between interlock disk 20 and dial 12 such that dial 12 may be rotated freely about interlock disk 20 when hole 32 is not engaging pin 18 of interlock disk 20.

Safety knob assembly 10 may be assembled in the following manner. As stated above, hole 36 of locking hub 28 engages switch post 24. Safety post 22 is sized to pass through hole 42 and engage hole 34 of dial 12. Prior to securing dial 12 on post 22, spring 16 is added to post 22 in between a bottom surface of dial 12 and a top surface of interlock disk 20.

Safety knob assembly 10 will function in the following manner. Knob assembly 10 is shown in the unlocked position in FIG. 2, meaning that knob assembly will not be able to actuate switch post 24 to allow energy to pass from an energy source to the burner. An individual would only be able to rotate dial 12 and interlock disk 20 freely relative to stove 14. Dial 12 and interlock disk 20 will not actuate switch post 24 in this configuration.

In order to enable knob assembly 10 to actuate switch post 24 and energize the burner, an individual will lift interlock disk 20 upward into dial 12 to enable prong 26 to engage locking hub 28 and locking pin 18 to engage alignment hole 32 on dial 12. (see FIG. 5 for one means to actuate safety knob 10 with two hands). With prong 26 engaging hub 28 and pin 18 engaging alignment hole 31, dial 12 may be rotated thereby rotating locking hub 28 and switch post 24 to actuate switch post 24 to energize the burner.

When the individual releases interlock disk 20, spring 16 will force interlock disk 20 downward and away from dial 12. Prong 26 will disengage from locking hub 28 and locking pin 18 will disengage from alignment holes 32. Dial 12 and interlock disk 20 will now spin freely about safety post 22 and will no longer be able to actuate switch post 24. In order to adjust the amount of energy flowing to the burner or stop the flow of energy to the burner, the individual will lift interlock disk 20 upward into dial 12 to enable prong 26 to engage locking hub 28 and locking pin 10 to engage alignment hole 32 on dial 12 as described above.

In another embodiment of the present invention, knob assembly 10 may be fashioned in a manner the enables knob 10 to engage and actuate switch post 24 after the initial actuation as described above. After initial actuation of the burner, dial 12, locking disk 20 and prong 26 may remain in the engaged position relative to switch post 24 to enable easy adjustments of the flow of energy to the burner or means to quickly stop the flow of energy to the burner by turning knob assembly 10 to the off position. Knob assembly 10 may be enabled in this manner to allow experienced cooks, responsible adults and young adults, and those attentive to the cooking process to quickly adjust the supply of energy to the burner or oven to ensure a more efficient cooking experience. The safety features described above will still be enabled upon initial actuation of knob assembly 10. The safety features described above will be re-enabled when knob assembly 10 is returned to the off position and the flow of energy to the burner has ceased.

In yet another embodiment of the present invention illustrated in FIGS. 11-14, interlock disk 62 includes a locking post 44 that extends outward from a bottom surface of locking disk 62. The surface of stove 14 includes a hole 46 sized to accept and secure locking post 44. Stove 14 may include multiple holes 46 sized to accept locking post 44. Holes 46 may be configured in a circular pattern on the surface of stove 14 and the position of each of holes 46 may be aligned with locking post 46 as safety knob assembly 10 is rotated about the surface of stove 14. Holes 46 may be used to capture locking post 46 and secure safety knob assembly in a variety of positions to adjust and maintain a desired amount of energy being delivered to the burner.

In this particular embodiment of the present invention, safety knob assembly 10 includes a locking hub 50. Hub 50 includes a safety post 58 that is secured to dial 12. Dial 12 includes a hole 34 (see FIG. 9) to is sized to accept safety post 58 and secure dial 12 to post 58.

As stated above, dial 12 also includes at least one alignment hole 32 (see FIG. 9) that is sized to accept locking pin 18 of interlock disk 20. Knob Assembly 10 also includes a spring 16 that is sized internally to allow safety post 58 to pass through freely. Spring is secured on post 58 between a shoulder 60 of hub 50 and dial 12. Spring 16 acts to maintain a clearance between shoulder 60 and dial 12 such that dial 12 may be rotated freely about hub 50 when hole 32 is not engaging pin 18 of interlock disk 20.

Hub 50 further includes a hole half-moon shaped hole 48 (see FIG. 13B) sized to accept switch post 24 and secure knob 10 to stove 12. Hub 50 also includes at least one tab 56 sized to engage at least one notch 54 positioned at hole 52 of interlocking disk 62.

Safety knob assembly 10 will function in the following manner. Knob assembly 10 is shown in the unlocked position in FIG. 11, meaning that knob assembly will not be able to actuate switch post 24 to allow energy to pass from an energy source to the burner. An individual would only be able to rotate dial 12 freely relative to stove 14. Dial 12 will not actuate switch post 24 in this configuration.

In order to enable knob assembly 10 to actuate switch post 24 and energize the burner, an individual will lift interlock disk 62 upward into dial 12 to enable notch 54 to engage tab 56 of locking hub 50. Locking pin 18 on disk 62 will engage alignment hole 32 on dial 12. Locking post 44 will be removed from hole 46 of stove 14. With notch 54 of disk 62 engaging tab 56 of hub 50, locking post 44 removed from hole 46 and pin 18 engaging alignment hole 31, dial 12 may be rotated thereby rotating locking hub 28 and switch post 24 to actuate switch post 24 to energize the burner.

When the individual releases interlock disk 62, spring 16 will force hub 50 and interlock disk 62 downward and away from dial 12. Notch 54 will disengage from tab 56 of locking hub 50 and locking pin 18 will disengage from alignment holes 32. Locking post 42 may reengage hole 46 on stove 14. Dial 12 will now spin freely about safety post 22 and will no longer be able to actuate switch post 24. In order to adjust the amount of energy flowing to the burner or stop the flow of energy to the burner, the individual will lift interlock disk 62 upward into dial 12 to enable notch 54 to engage tab 56 of locking hub 50, enable post 44 to be lifted out of hole 46 and enable locking pin 10 to engage alignment hole 32 on dial 12 as described above.

In still another embodiment of the present invention, knob assembly 10 may be fashioned in a manner the enables knob 10 to engage and actuate switch post 24 after the initial actuation as described above. After initial actuation of the burner, dial 12, locking disk 62, notch 54 and tab 56 may remain in the engaged position and locking post 44 may be free of hole 46 relative to switch post 24 to enable easy adjustments of the flow of energy to the burner or means to quickly stop the flow of energy to the burner by turning knob assembly 10 to the off position. Knob assembly 10 may be enabled in this manner to allow experienced cooks, responsible adults and young adults, and those attentive to the cooking process to quickly adjust the supply of energy to the burner or oven to ensure a more efficient cooking experience. The safety features described above will still be enabled upon initial actuation of knob assembly 10. The safety features described above will be re-enabled when knob assembly 10 is returned to the off position and the flow of energy to the burner has ceased.

Figure 15:
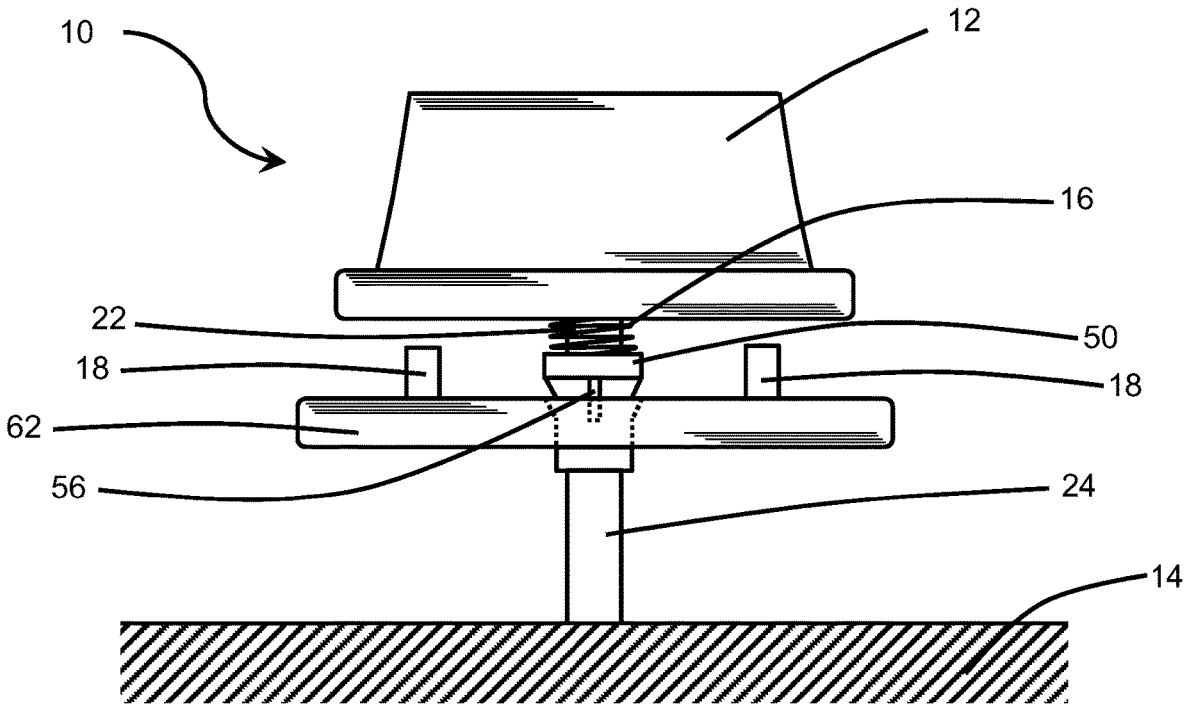
FIG. 15 is a side view of a safety knob assembly shown in a first position according to yet another embodiment of the present invention.
Figure 16:
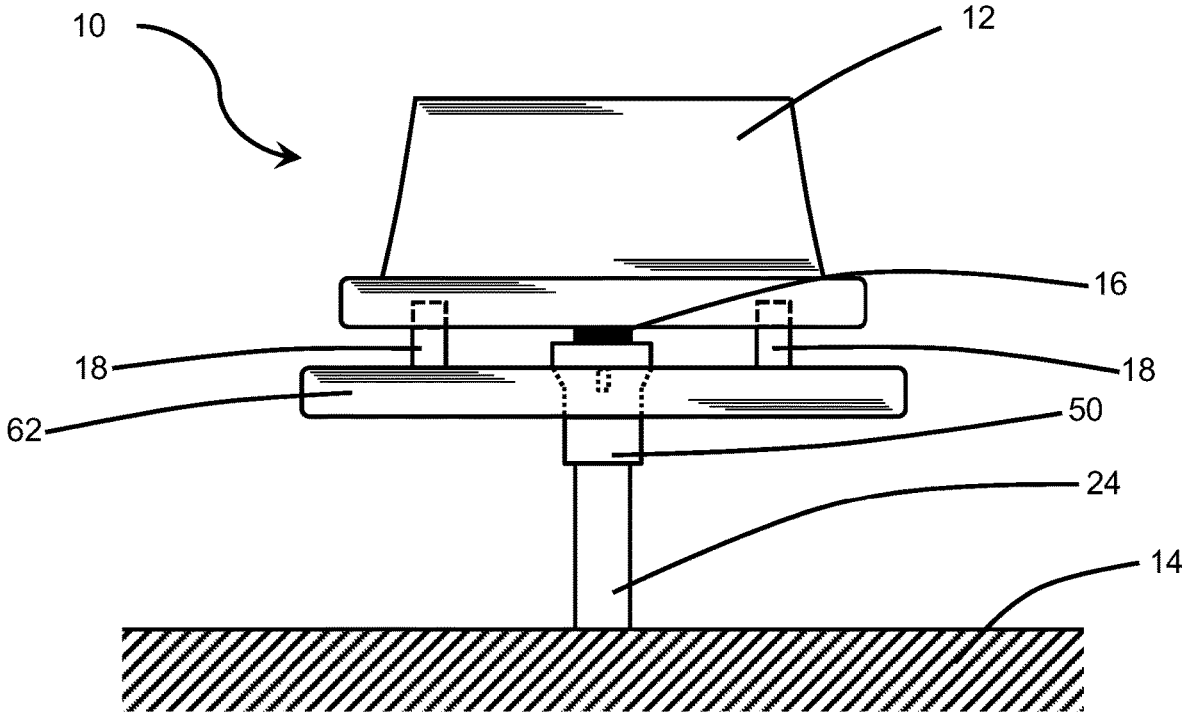
FIG. 16 is a side view of a safety knob assembly shown in a second position according to an embodiment of the present invention.
Figure 17:
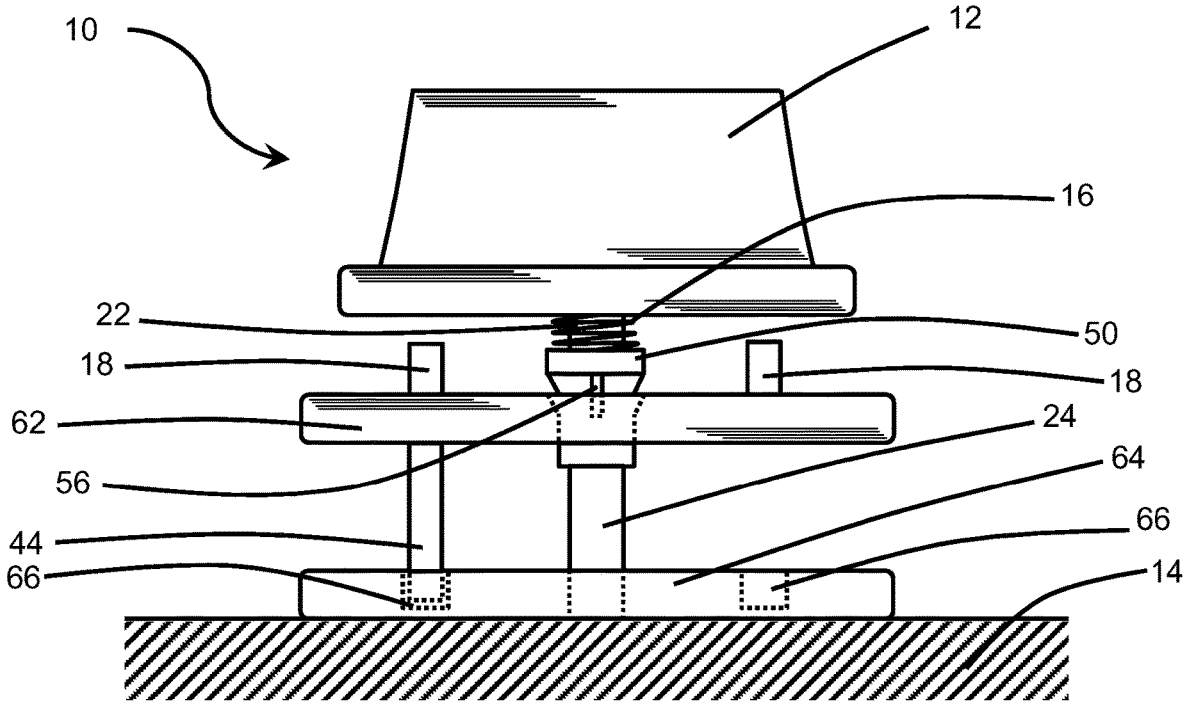
FIG. 17 is a side view of a safety knob assembly shown in a first position according to still another embodiment of the present invention.

In yet another embodiment of the present invention illustrated in FIGS. 15 and 16, safety knob assembly 10 may operate as described above and illustrated in FIGS. 11-14 without locking post 44 and the corresponding hole 46 in the surface of stove 14. Knob assembly 10 may be constructed in this manner if knob assembly 10 were to be used as a replacement knob on an existing stove, oven, grill and the like and the particular stove, oven, grill and the like did not have a surface with holes to accept locking post 44. Alternatively, a locking ring 66 may be secured onto the surface of a stove, oven, grill and the like to provide at least one hole 68 to accept locking post 44 as illustrated in FIG. 17.

Safety knob assembly 10 has been illustrated and described above in conjunction with stove 14, however, it is important to note that safety knob assembly 10 may be used with any device that regulates the flow of energy from an energy source to a burner. Those devices may include, for example, an oven, an indoor or outdoor grill, a boiler, a water heater, a log assembly in a gas or electric fireplace, a furnace and the like.

The components of safety knob assembly 10 may be manufactured of any material including but not limited to, any number of plastics or polymers and metals or alloys that may suitable to the environment knob 10 will be used. The choice of materials used to manufacture safety knob assembly 10 will not detract from any of the inventive aspects describe above.

The present invention has been particularly shown and described with reference to the foregoing embodiment, which is merely illustrative of the best modes presently known for carrying out the invention. It should be understood by those skilled in the art that various alternatives to the embodiment of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiment is illustrative, and no single feature or element is essential to all possible combinations that may be claimed in this or a later application.

What is claimed is:

1. A safety knob assembly for actuating a burner, said safety knob assembly including:

a dial; said dial including at least one alignment hole;

an interlock disk, said interlock disk including at least one locking pin, said at least one locking pin having an outer diameter less than then an inner diameter of said at least one alignment hole;

a safety post, said safety post connected to said dial and said safety post including a locking hub, said locking hub connected to a switch post;

a spring, said spring sized such that an inner diameter of said spring is larger than an outside diameter of said safety post, said spring positioned on said safety post and positioned between said dial and said locking hub;

wherein said at least one locking pin of said interlock disk engages said at least one alignment hole of said dial as a bottom surface of said dial approaches a top surface of said interlock disk;

wherein said interlock disk engages said locking hub as a bottom surface of said interlock disk approaches said locking hub; and wherein the burner is actuated as said dial, said interlock disk, said safety post and said locking hub are positioned to rotate said switch post relative to the burner to allow the flow of energy from an energy source to the burner.

2. The safety knob assembly as recited in claim 1, wherein said interlock disk includes at least one prong, said at least one prong sized to engage a void of said locking hub as said dial, said interlock disk, said safety post and said locking hub are positioned to rotate said switch post relative to the burner to allow the flow of energy from the energy source to the burner.

3. The safety knob assembly as recited in claim 1, wherein said interlock disk includes at least one notch positioned at a hole of said interlock disk, said at least one notch sized and positioned to engage a tab of said locking hub as said dial, said interlock disk, said safety post and said locking hub are positioned to rotate said switch post relative to the burner to allow the flow of energy from the energy source to the burner.

4. The safety knob assembly as recited in claim 3, wherein said interlock disk includes a locking post that extends outward from the bottom surface of said interlock disk, said locking post sized to engage a hole on a front surface of a device supporting the burner.

5. A safety knob assembly for actuating a burner, said safety knob assembly including:

a dial; said dial including at least one alignment hole;

an interlock disk, said interlock disk including at least one locking pin, said at least one locking pin having an outer diameter less than then an inner diameter of said at least one alignment hole and said interlock disk further including at least one prong;

a safety post, said safety post connected to said dial and said safety post including a locking hub, said locking hub including at least one void and said locking hub connected to a switch post;

a spring, said spring sized such that an inner diameter of said spring is larger than an outside diameter of said safety post, said spring positioned on said safety post and positioned between said dial and said locking hub;

wherein said at least one locking pin of said interlock disk engages said at least one alignment hole of said dial as a bottom surface of said dial approaches a top surface of said interlock disk;

wherein said at least one prong of said interlock disk engages said void of said locking hub as a bottom surface of said interlock disk approaches said locking hub; and wherein the burner is actuated as said dial, said interlock disk, said safety post and said locking hub are positioned to rotate said switch post relative to the burner to allow the flow of energy from an energy source to the burner.

6. A safety knob assembly for actuating a burner, said safety knob assembly including:

a dial; said dial including at least one alignment hole;

an interlock disk, said interlock disk including at least one locking pin, said at least one locking pin having an outer diameter less than then an inner diameter of said at least one alignment hole and said interlock disk further including at least one notch;

a safety post, said safety post connected to said dial and said safety post including a locking hub, said locking hub including at least one tab and said locking hub connected to a switch post;

a spring, said spring sized such that an inner diameter of said spring is larger than an outside diameter of said safety post, said spring positioned on said safety post and positioned between said dial and said locking hub;

wherein said at least one locking pin of said interlock disk engages said at least one alignment hole of said dial as a bottom surface of said dial approaches a top surface of said interlock disk;

wherein said at least one notch of said interlock disk engages said at least one tab of said locking hub as a bottom surface of said interlock disk approaches said locking hub; and wherein the burner is actuated as said dial, said interlock disk, said safety post and said locking hub are positioned to rotate said switch post relative to the burner to allow the flow of energy from an energy source to the burner.

7. The safety knob assembly as recited in claim 6, wherein said interlock disk includes a locking post that extends outward from the bottom surface of said interlock disk, said locking post sized to engage a hole on a front surface of a device supporting the burner.

* * * * *